US011359359B2

(12) United States Patent
McHugh, IV

(10) Patent No.: US 11,359,359 B2
(45) **Date of Patent: *Jun. 14, 2022**

(54) APPARATUS, METHODS AND ARTICLES OF MANUFACTURE FOR DRY PIPE SPRINKLER SYSTEM

(71) Applicant: AGF Manufacturing Inc., Malvern, PA (US)

(72) Inventor: George Joseph McHugh, IV, Malvern, PA (US)

(73) Assignee: AGF MANUFACTURING, INC., Malvern, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/087,993

(22) Filed: Nov. 3, 2020

(65) Prior Publication Data

US 2021/0047811 A1 Feb. 18, 2021

Related U.S. Application Data

(60) Continuation of application No. 15/352,154, filed on Nov. 15, 2016, now Pat. No. 10,829,914, which is a division of application No. 13/604,592, filed on Sep. 5, 2012, now abandoned.

(51) Int. Cl.

| | |
|---|---|
| ***E03B 7/12*** | (2006.01) |
| ***A62C 35/62*** | (2006.01) |
| ***A62C 3/00*** | (2006.01) |
| ***E03B 7/08*** | (2006.01) |
| ***E03B 7/09*** | (2006.01) |

(52) U.S. Cl.

CPC ..... *E03B 7/12* (2013.01); *A62C 3/004* (2013.01); *A62C 35/62* (2013.01); *E03B 7/08* (2013.01); *E03B 7/095* (2013.01); *Y10T 137/0318* (2015.04); *Y10T 137/8158* (2015.04)

(58) Field of Classification Search

CPC ... E03B 7/12; E03B 7/08; E03B 7/095; A62C 3/004; A62C 35/62; Y10T 137/0318; Y10T 137/8158

See application file for complete search history.

(56) References Cited

U.S. PATENT DOCUMENTS

| | | | | |
|---|---|---|---|---|
| 2,141,855 | A * | 12/1938 | Dodge | F24F 5/0007 454/337 |
| 3,702,636 | A | 11/1972 | Hart | |
| 5,921,270 | A | 7/1999 | McCarthy | |
| 8,443,908 | B2 * | 5/2013 | McHugh, IV | A62C 35/62 169/17 |
| 2008/0277125 | A1 | 11/2008 | Wilkins | |
| 2009/0020166 | A1 | 1/2009 | Mchugh | |
| 2010/0273069 | A1 | 10/2010 | Crumm | |

* cited by examiner

*Primary Examiner* — P. Macade Nichols
(74) *Attorney, Agent, or Firm* — Buchanan Ingersoll & Rooney PC

(57) ABSTRACT

An apparatus and method for maintaining integrity of a dry pipe sprinkler system. The apparatus includes an auxiliary drain, the auxiliary drain including an input pipe, a condensate collection area, and a drain pipe; an insulated housing with a door configured to provide a heat controlled environment for the auxiliary drain, and wherein the auxiliary drain is at least partially located within the housing, and the condensation collection area is located within the housing; a heater configured to heat the housing; and an auxiliary drain alarm configured to provide a warning when the auxiliary drain retains a predetermined amount of condensate.

20 Claims, 5 Drawing Sheets

APPARATUS, METHODS AND ARTICLES OF MANUFACTURE FOR DRY PIPE SPRINKLER SYSTEM

CROSS-REFERENCES TO RELATED APPLICATIONS

This application is a continuation of U.S. patent application Ser. No. 15/352,154 filed on Nov. 15, 2016, which is a divisional of U.S. patent application Ser. No. 13/604,592, filed on Sep. 5, 2012, the entire content of both of which is incorporated herein by reference.

TECHNICAL FIELD

The present disclosure generally relates to dry pipe sprinkler systems or pre-action systems and, more particularly, to auxiliary drains, also known as condensate collectors or drum drips.

BACKGROUND

A dry pipe sprinkler system or pre-action system comprises a fire suppression system that is typically used in structures and areas that are oftentimes unheated and subject to freezing temperatures. The dry pipe sprinkler system includes a network of pipes including branch lines servicing sprinkler heads, risers, and feed mains for delivering water from a water supply to the branch lines. Under normal conditions, this network of pipes contains a pressurized gas, such as air or nitrogen, which holds closed a dry pipe valve that connects the main supply pipes of main feeds of the sprinkler system to the water supply. When heat from a fire opens a sprinkler, the compressed gas is released from the system. The resulting drop in pressure causes the dry pipe valve to open, or trip, thereby releasing water into the main supply lines or main feeds.

When the network of pipes is filled with the pressurized gas and the ambient temperature lowers, condensate can collect in the network of pipes. If the condensate builds up in the system, then there is a risk that the condensate will freeze in the pipes. Freezing condensate can cause pipes to leak or burst, or inhibit the flow of water through the branch lines in the event of fire. For this reason, dry pipe systems often include one or more auxiliary drains, also known as condensate collector arrangements or drum drips, which collect condensate from the network of pipes. These auxiliary drains are typically located at low points of the dry pipe system and made of a section of larger diameter pipe serving as a condensate collection area, with a smaller diameter pipe at the top and bottom, serving as supply and drain respectively. An upper valve functions as a shut-off valve and a lower valve as a drainage valve. An auxiliary drain is drained of condensate by first closing the upper valve. This prevents pressurized gas from exiting the system when the auxiliary drain is being drained. The drain valve is then opened and condensate is drained from the condensate collection area. Then the drain valve is closed again and the upper valve may be reopened to again allow condensate to be collected.

Whether an auxiliary drain uses a two valve or other arrangement, it may itself be subject to freezing temperatures, and so be in danger of damage from the condensate it collects freezing and/or alternately freezing and thawing. Such damage could lead to failure of the drain and/or the entire system to which the drain is connected. The damage may be limited through a rigorous drainage schedule and/or insulation on the drain, but such measures may be less than ideal and/or poorly implemented.

SUMMARY

The preferred embodiments provide apparatus, methods, and articles of manufacture for maintaining the integrity or pressurization of a dry pipe sprinkler system by preventing damage to auxiliary drains from freezing temperatures. A housing is used for providing a controlled environment about an auxiliary drain, insulated and with a heater. The housing is weather resistant and a locking door is provided for access to the auxiliary drain.

The heater is thermostatically controlled so that it operates when the ambient temperature is below 40 degrees Fahrenheit. There are various entry ways or penetrations into the housing, for the dry pipe, power for the heater and the like, and these are sealed, minimizing penetration into the interior by nuisances such as bees or other unwanted intruders.

An alarm, which may or may not include a trigger component as used herein, may be provided as well in order to provide warning if said auxiliary drain retains a predetermined amount of condensate. (for example, a float switch alone, a float switch connected to an alarm, etc.) Embodiments may, as well, provide a housing that is retrofit about an existing auxiliary drain or be provided with an auxiliary drain for installation upon a dry pipe sprinkler system.

In accordance with an aspect, an apparatus is disclosed for a dry pipe sprinkler system, the apparatus comprising: an auxiliary drain, the auxiliary drain including an input pipe, a condensate collection area, and a drain pipe; an insulated housing with a door configured to provide a heat controlled environment for the auxiliary drain, and wherein the auxiliary drain is at least partially located within the housing, and the condensation collection area is located within the housing; a heater configured to heat the housing; and an auxiliary drain alarm configured to provide a warning when the auxiliary drain retains a predetermined amount of condensate.

In accordance with another aspect, a method for maintaining integrity of a dry pipe sprinkler system, comprising: providing an insulated housing with a door for providing a heat controlled environment for an auxiliary drain, the auxiliary drain including an input pipe, a condensate collection area, and a drain pipe, and wherein the auxiliary drain is at least partially located within the housing, and the condensation collection area is located within said housing; providing heat to the insulated housing; and providing an auxiliary drain warning when the auxiliary drain retains a predetermined amount of condensate.

DETAILED DESCRIPTION OF THE PREFERRED EMBODIMENTS

Figure 1:
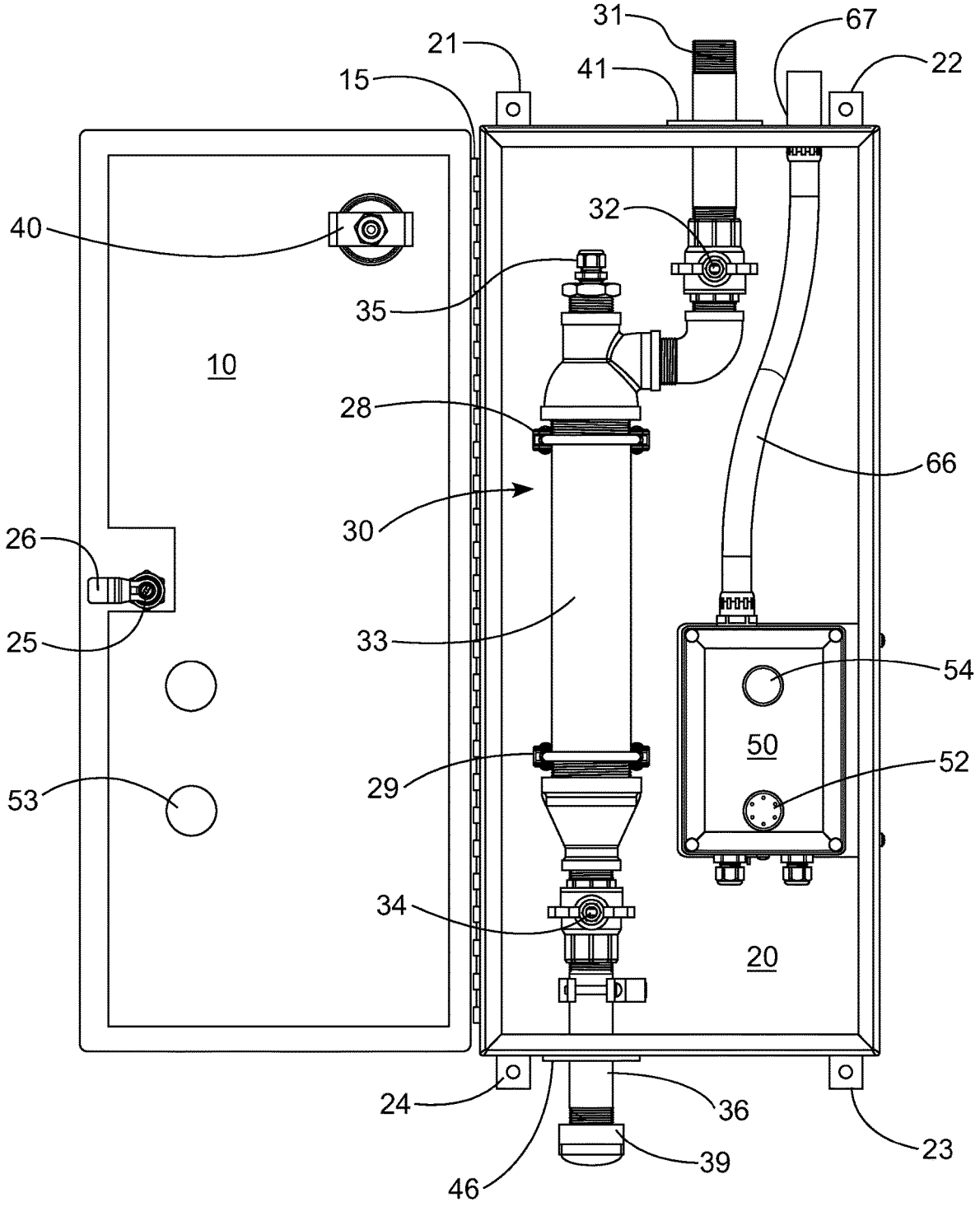
FIG. 1 shows a view of a preferred embodiment.

FIG. 1 shows a preferred embodiment with open door 10. Door 10 is hinged on piano hinge 15 and closes on housing 20. Door 10 and housing 20 are made of steel and insulated with ½ inch thick foil faced foam board insulation provided to retain heat, as will be further described below. It should be noted that in this and other embodiments alternative construction may be used as well, all of which are intended to be within the scope of the disclosure as defined in the claims herein.

Figure 5:
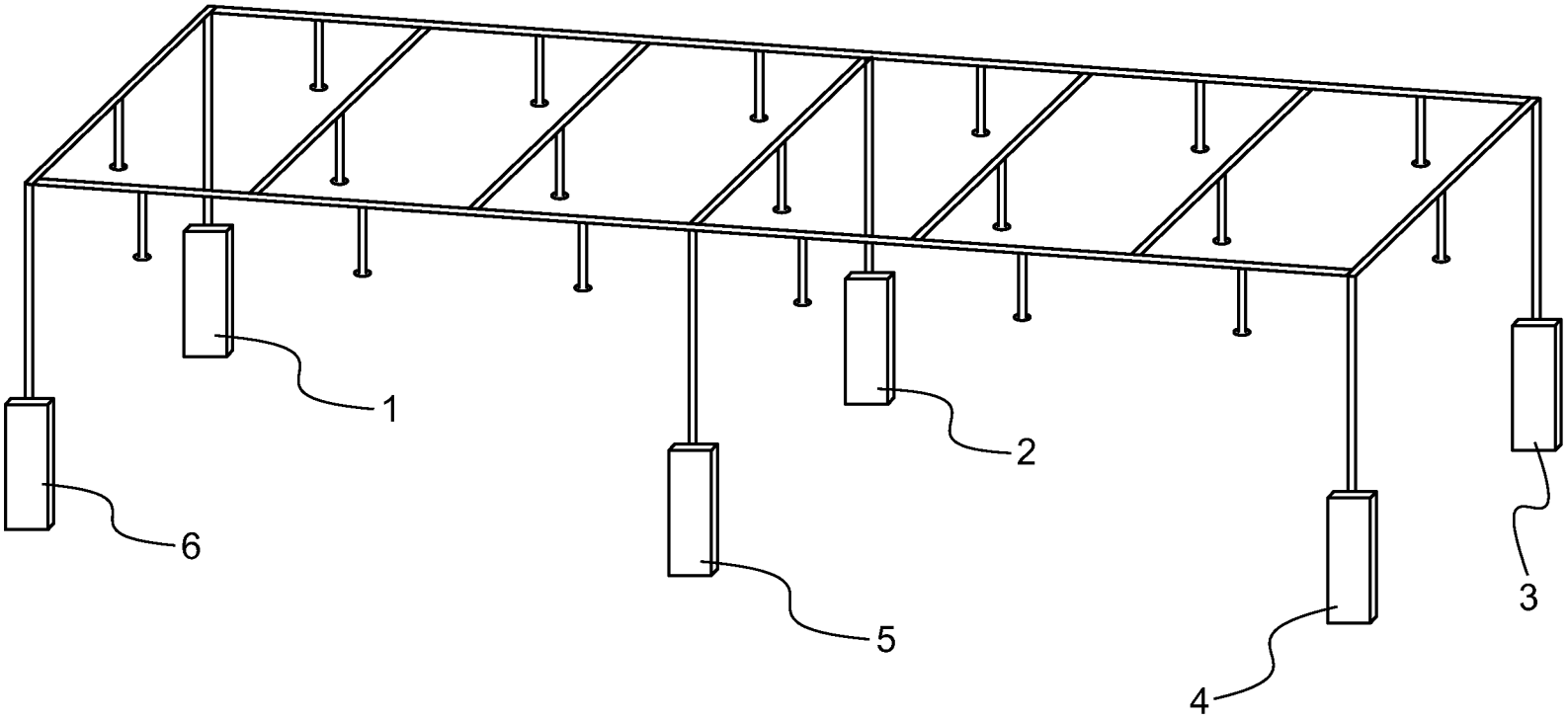
FIG. 5 shows a view of another preferred embodiment.

Tabs 21-24 are for mounting upon a concrete pillar, wall or other surface as may be desired, and turning briefly to FIG. 5 a schematic of a dry pipe sprinkler system is seen as might be present on a floor of a parking garage or the like with embodiments shown at 1-6 depending from corners of the system. Returning to FIG. 1, key lock 25 and attendant latch 26 is shown on the inside of door 10. Within housing 20, auxiliary drain 30 is shown, and is mounted to housing 20 with top u-bolt 28 and bottom u-bolt 29.

Extending from the top of housing 20 is input pipe 31, which is connected in turn to a dry pipe sprinkler system (not shown.) Upper valve 32 controls input pipe 31 which then leads into condensate collection area 33. Also at the top of the condensate collection area 33 is float type level switch 35 which allows the unit to fill. As is further described below however if the unit does fill to a preset level, alarm 52 will be triggered. In this and other embodiments, the float type level switch 35 may be set so various levels of condensate may trigger an alarm. Of course, yet other embodiments may dispense with a float type level switch entirely, and an alarm be set to trigger with any amount of condensate. The alarm, it should be noted, may be pre-set, set upon installation, or set during operation, and be set locally and/or from a central location in various embodiments.

Depending from condensate collection area 33 is lower drainage valve 34 which, when opened, provides for drainage from condensate collector 33 through drain 36. Input pipe 31 travels into housing 20 via pass-through 41, which, as had been described above, is sealed to prevent nuisances such as bees or other unwanted intruders from entering. There may or may not be a seal, a seal may be water resistant or proofed, other protections as known in the art, etc. may be used as desired in various embodiments. Drain pipe 36 travels through pass-through 46, which is also sealed in a similar manner to pass-through 41. Cap 39 can be removed to drain the auxiliary drain 30, desirably in an appropriate procedure that maintains pressurization, as is described for example in NFPA 25 guidelines. Although the preferred embodiments are within a locking cabinet, and it may not be desired to have an Anti-Trip device, e.g., a wire or plate, other embodiments may use an Anti-Trip device e.g., a wire or plate as desired.

Thermometer 40 displays the temperature inside the housing 20 though its external dial (not shown.) In various embodiments that temperature may be monitored and an alarm be set to provide warning if the inside temperature fell below a predetermined level. That alarm may be local and/or be sent to a central location as desired. It should be noted that, although the preferred embodiments contain an auxiliary drain, it might be desired in other embodiments to provide a retrofit embodiment to install around an existing auxiliary drain.

Electrical enclosure 50 contains components for an alarm as well as other components such as circuit protection, a relay and terminal blocks. The alarm 52 extends through recess 53 and provides an audible sound (e.g., buzzer) and light when the auxiliary drain is full of condensate. In other embodiments, it should be noted and as was described above, the alarm may trigger when varying amounts, or any at all, of condensate accumulates. The alarm enclosure 50 is at least a NEMA 4× enclosure in the preferred embodiments as set forth in the National Electrical Manufacturers Association Standards Publication 250-2003.

Conduit 66 provides power to a heater (or heating element, the words are used interchangeably herein) (not shown here, see FIG. 2) and alarm 52, which in the preferred embodiments is 120V and enters the housing 20 through pass-through 67, which is sealed similarly to the other pass-through 41 and 46.

Figure 2:
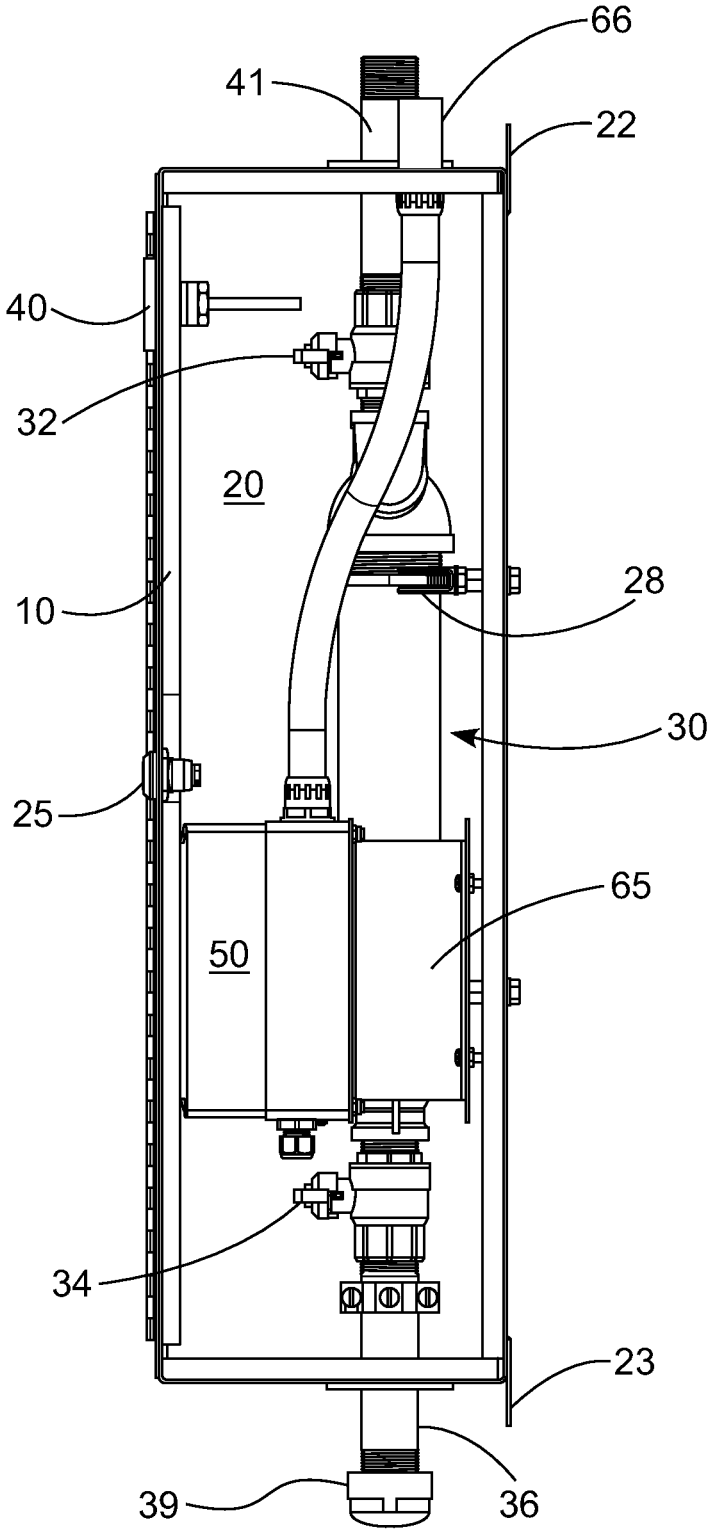
FIG. 2 shows a side view of the embodiment of FIG. 1.

Turning to FIG. 2, a side view of the embodiment of FIG. 1, a heater 65 is behind enclosure 50. In the preferred embodiments, the heater is sized appropriately, (e.g., a 60 W heater in the preferred embodiments) and provides the interior of housing 20 with an air temperature of from 40 to 60 degrees F., which may be set by thermostat, be preset, allow for setting during or after installation, be set from a central control area, etc.

It should be noted that embodiments may provide for centralized control as well, with the alarm settings, drainage, heater and other components being monitored and/or manipulated from a central location. Embodiments may include as well a test device to confirm the alarm and other components are working correctly, which may as well be local and/or activated and/or monitored from a central location. The embodiment of FIG. 1 shows a test pushbutton 54, for example, for testing functionality of the alarm system.

Figure 3:
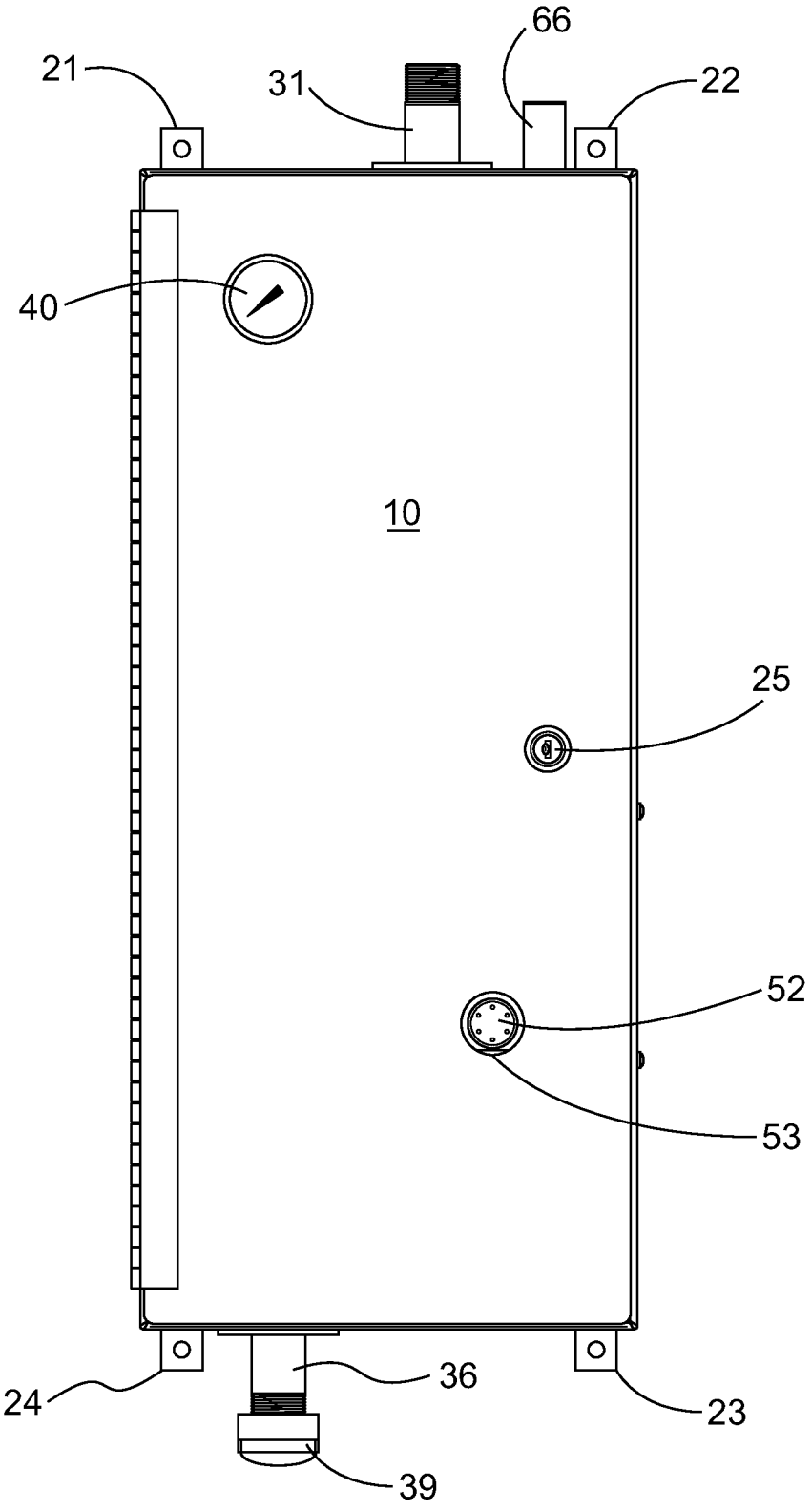
FIG. 3 shows a front view of the embodiment of FIG. 1.
Figure 4:
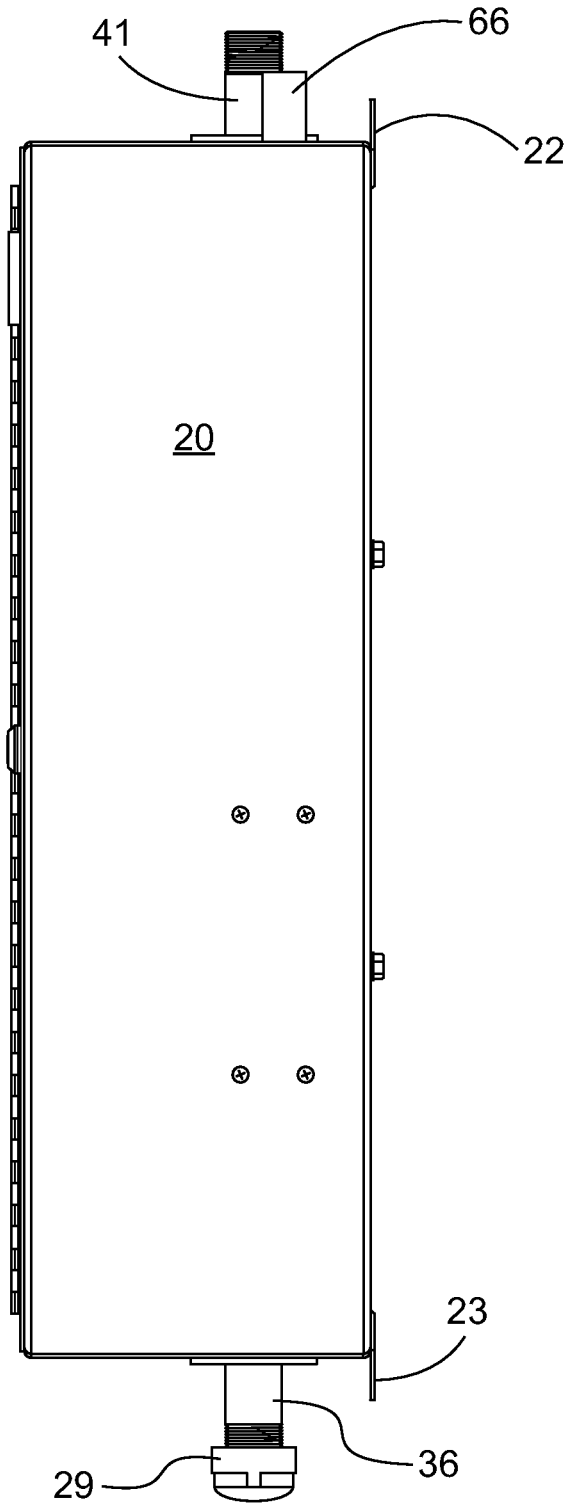
FIG. 4 shows a side view of the embodiment of FIG. 1.

Turning briefly to FIGS. 3 and 4, a view of housing 20 with door 10 closed is seen. FIG. 3 is a front view with thermometer 40, alarm 52 and key lock 25 visible. FIG. 4 is a side view of housing 20 with the door closed.

The foregoing description is provided as an enabling teaching of the disclosure in its currently known embodiments. Those skilled in the relevant art will recognize that many changes can be made to the embodiments described while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and may even be desirable in certain circumstances and are a part of the present disclosure. Thus, the following description is provided as illustrative of the principles of the present disclosure and not in limitation thereof, since the scope of the present disclosure is defined by the claims.

What is claimed is:

1. An apparatus for a dry pipe sprinkler system, the apparatus comprising:

an auxiliary drain, the auxiliary drain including an input pipe, a condensate collection area, and a drain pipe;

an insulated housing with a door configured to provide a heat controlled environment for the auxiliary drain, and wherein the auxiliary drain is at least partially located within the housing, and the condensation collection area is located within the housing;

a heater configured to heat the housing; and an auxiliary drain alarm configured to provide a warning when the auxiliary drain retains a predetermined amount of condensate.

2. The apparatus according to claim 1, wherein the auxiliary drain alarm is triggered when a float level switch within the condensate collection area reaches a preset level within the condensate collection area.

3. The apparatus according to claim 1, wherein the insulated housing is a weather resistant insulated housing.

4. The apparatus according to claim 1, wherein the insulated housing further comprises a locking door.

5. The apparatus according to claim 1, wherein the heater is thermostatically controlled.

6. The apparatus according to claim 5, wherein the heater is configured to provide an air temperature within the insulated housing of between 40 degrees Fahrenheit to 60 degrees Fahrenheit.

7. The apparatus according to claim 1, wherein the auxiliary drain alarm is centrally controlled.

8. The apparatus according to claim 1, wherein the auxiliary drain alarm is arranged on an exterior of the insulated housing and is configured to provide an audible sound and/or a light when the auxiliary drain retains the predetermined amount of the condensate.

9. The apparatus according to claim 1, further comprising:

an exterior temperature readout configured to provide air temperature within the insulated housing.

10. The apparatus according to claim 9, further comprising:

a temperature alarm configured to provide a warning when the air temperature within the insulated housing falls below a predetermined temperature.

11. The apparatus according to claim 10, wherein the temperature alarm is centrally controlled.

12. The apparatus according to claim 1, further comprising:

a test device for providing assurance of proper operation of said alarm.

13. A method for maintaining integrity of a dry pipe sprinkler system, comprising:

providing an insulated housing with a door for providing a heat controlled environment for an auxiliary drain, the auxiliary drain including an input pipe, a condensate collection area, and a drain pipe, and wherein the auxiliary drain is at least partially located within the housing, and the condensation collection area is located within said housing;

providing heat to the insulated housing; and providing an auxiliary drain warning when the auxiliary drain retains a predetermined amount of condensate.

14. The method according to claim 13, further comprising:

thermostatically controlling the providing of the heat to the insulated housing.

15. The method according to claim 13, further comprising:

centrally controlling the auxiliary drain alarm.

16. The method according to claim 13, further comprising:

providing a temperature warning when an interior temperature of the insulated housing falls below a predetermined temperature.

17. The method according to claim 16, further comprising:

centrally controlling the temperature drain alarm.

18. The method according to claim 13, further comprising:

providing an audible sound and/or a light when the auxiliary drain retains the predetermined amount of the condensate with the auxiliary drain alarm, which is arranged on an exterior of the insulated housing.

19. The method according to claim 13, further comprising:

providing air temperature within the insulated housing on exterior temperature readout.

20. The method according to claim 19, further comprising:

providing a warning when the air temperature within the insulated housing falls below a predetermined temperature with a temperature alarm.

* * * * *